US008573875B2

(12) United States Patent
Gieux et al.

(10) Patent No.: US 8,573,875 B2
(45) Date of Patent: Nov. 5, 2013

(54) APPLICATOR FOR A FLUID PRODUCT SUCH AS A COSMETIC PRODUCT

(75) Inventors: Gerard Gieux, Paris (FR); Franck Le Crosnier, Choisy le Roi (FR)

(73) Assignee: Figie Luxembourg S.A., Luxembourg (LU)

( * ) Notice: Subject to any disclaimer, the term of this patent is extended or adjusted under 35 U.S.C. 154(b) by 1040 days.

(21) Appl. No.: 12/278,150

(22) PCT Filed: Jan. 23, 2007

(86) PCT No.: PCT/FR2007/050677

§ 371 (c)(1),
(2), (4) Date: Dec. 9, 2008

(87) PCT Pub. No.: WO2007/088296

PCT Pub. Date: Aug. 9, 2007

(65) Prior Publication Data

US 2010/0028070 A1 Feb. 4, 2010

(30) Foreign Application Priority Data

Feb. 3, 2006 (FR) ..... 06 00986

(51) Int. Cl.
*A46B 11/04* (2006.01)

(52) U.S. Cl.
USPC ..... 401/281; 401/270

(58) Field of Classification Search
USPC ..... 401/270, 277, 280, 281
See application file for complete search history.

(56) References Cited

U.S. PATENT DOCUMENTS

2004/0047674 A1 3/2004 Geardino
2004/0211781 A1 10/2004 Lin

FOREIGN PATENT DOCUMENTS

| | | |
|---|---|---|
| EP | 1 407 976 | 4/2004 |
| FR | 2 514 327 | 4/1983 |
| GB | 2 232 074 | 12/1990 |

OTHER PUBLICATIONS

International Search Report dated Jul. 31, 2007 in English.

*Primary Examiner* — Tuan N Nguyen
(74) *Attorney, Agent, or Firm* — Dickinson Wright PLLC

(57) ABSTRACT

The invention relates to an applicator for a fluid product such as a cosmetic product, of the type including: a container (101) having an outlet, a control ring (133) which is mounted to the container such that it can move between a closed position in which it seals the outlet and an open position in which it opens the outlet, and an application member (155) which is mounted to the control ring such as to communicate with the outlet when the ring is in the open position. The control ring is rotatably mounted to the container, abutment means (129, 135) being provided in order to stop the travel of the ring towards the closed position thereof.

12 Claims, 9 Drawing Sheets

158
155
B
109
101
135
133
121
G
F
I
H
131
129
J
115
139
117
123
153
159
165
169
143
119
141
163
167
111

109
B
155
133
101
K
H
I
F
G
153
123
121
119
141
157
137
127
135
115
117,143
131
139
129
J
f 258
255
B
209
201
235
233
221
G
F
I
H
231
229
J
215
239
253
243
219
241
217
261
223
265
269
263
267

255
233
201
209
219
221
223
241
253
257
237
227
243
217
215
217,243
235
231
229
239
B
K
G
H
F
I
J
f 361
359
358
A
355
APPLICATION MEMBER
CONTROL RING
333
335
STOP MEANS
A
309
304
305
303
A
301
CONTAINER 359
361
363
367
369
365

357
328
330
333
332
336
334

334
332
336
330
328
333

324
326
322
331
323
321
309
329
325
STOP MEANS 317
327
331
309
304
305
303
301
307

358
355
333
309
301
E
H
G
F
I
336
332
330
328
326
324
322
321
319
317
323
320
334
303
357
338

355
333
309
301
303
304
321
322
323
324
326
328
330
332
334
336
338
317
319
320
357
f
E
F
G
H
I
J

APPLICATOR FOR A FLUID PRODUCT SUCH AS A COSMETIC PRODUCT

FIELD OF THE INVENTION

The present invention relates to an applicator for a fluid product, such as a cosmetic product.

BACKGROUND OF THE INVENTION

In the context of the present invention, the term "fluid" is intended to refer to a product which may be liquid, semi-liquid, creamy or pulverulent.

There are known from the prior art, and particularly from patent applications EP 1 407 976, US 2004/047674 and GB 2 232 074, applicators for a fluid product, such as a cosmetic product, of the type comprising:

- a container which is provided with a discharge opening,
- a control ring which is mounted so as to be movable on the container between a closed position, in which it blocks the opening, and an open position, in which it releases the opening, and
- an application member which is mounted on the control ring so as to communicate with the opening when the ring is in its open position.

Such an applicator can be used in particular for applying make-up foundation powder to the face of a user.

In such an applicator, the control ring is conventionally mounted with helical movement on the container. In other words, in order to open and close the container, the control ring is unscrewed or screwed.

During the use of the applicator, such helical movement leads to given wear (or matting) of the plastics material which forms the various components, in particular in the zone of the screw threads of those components.

As a result, in order to obtain the necessary tightness in the closed position, it is necessary, after each use, to screw the control ring slightly further onto the container.

This is troublesome when the control ring and the container must be mutually aligned in a very particular manner in the closed position, in particular for aesthetic reasons owing to their shape or their appearance.

This may be necessary, for example, because the control ring and the container have shapes which are non-circular (for example, elliptical), which must correspond to each other in the closed position.

This may also be necessary, for example, because the control ring and the container comprise logos and/or decorations which must correspond in the closed position.

In order to overcome those disadvantages, it has been conceived to position an end stop for screwing travel of the control ring on the container.

Although it allows effective alignment of the control ring with respect to the container in the closed position, such a stop has the disadvantage of preventing securing with wear compensation.

In this manner, after a given number of uses bringing about respective wear of the control ring and the container, this results in an applicator which, in the closed position, is not completely fluid-tight, which is obviously very troublesome.

SUMMARY OF THE INVENTION

An object of the present invention is to provide an applicator which allows, during the entire service life thereof, a predetermined alignment of the control ring to be maintained with respect to the container in the closed position, whilst providing complete tightness.

This object of the invention is achieved with an applicator for a fluid product, such as a cosmetic product, of the type comprising:

- a container which is provided with a discharge opening,
- a control ring which is mounted so as to be movable on the container between a closed position, in which it blocks the opening, and an open position, in which it releases the opening,
- an application member which is mounted on the control ring so as to communicate with the opening when the ring is in its open position, in which applicator the control ring is mounted with simple rotation on the container, stop means (129, 135, 229, 235; 329, 335) being provided in order to stop the travel of the ring towards its closed position.

Owing to the fact that the control ring is mounted with simple rotation on the container, it is possible to dispense with helical movement and the disadvantages thereof.

The closing travel end stop ensures correct positioning of the control ring with respect to the container in accordance with predetermined alignment.

It will further be appreciated that the simple rotation movement allows the number of tolerances to be taken into consideration in the production of the control ring and the container to be limited.

According to other optional features of this applicator in accordance with the invention:

- it further comprises a removable cover which is mounted on the control ring, and means for locking the cover on the control ring when the ring is in the closed position, and for unlocking the cover when the ring is in its open position,
- the locking/unlocking means comprise:
- at least two discs which are fixedly joined to the container and which are axially spaced apart from each other, and each of which is provided with a notch, the notches of the two discs being diametrically opposed,
- at least two housings which are formed in the control ring, those housings each receiving one of the discs and being arranged so that, when the control ring is in the open position, the notches are in the housings, respectively, and
- at least two grooves which are formed inside the cover and which are arranged so as to be positioned in the housings and to cooperate with the discs, respectively, those grooves being formed in order to prevent the cover from being removed as long as the notches are not in the housings and in order to allow removal when those notches are in those housings, respectively,
- the control ring and the cover are formed so as to allow only a single relative positioning of those two components,
- the blocking and release of the opening is brought about by cooperation between two complementary curved members which are provided with holes and which are fixedly joined to the control ring and the container, respectively, the holes of those members being mutually displaced when the control ring is in its closed position and those holes being at least partially opposite each other when the control ring is in its open position,
- the control ring is mounted with simple rotation on the container by means of a support ring which is itself mounted so as to be fixed in position on this container, the support ring comprising the two discs which are provided with notches and one of the curved members, the control ring and the support ring comprise complementary recesses, respectively, at the bottom of which the curved members are positioned, those recesses extending inside the opening, the blocking and release of the opening is brought about by cooperation between skirts which are provided with complementary serrations which are fixedly joined to the control member and the container, respectively, the serrations of those skirts being mutually displaced when the control ring is in its closed position, and those serrations being at least partially opposite each other when the control ring is in its open position, the skirts are positioned outside the container, the skirts are positioned inside the container, the application member is mounted on a support which is itself mounted so as to be removable on the control ring, the container is a tube which may be of any shape, and which is particularly elliptical, circular, square or triangular, the shapes of the control ring, the cover and, where applicable, the support ring and the application member support being adapted in order to correspond to the shape of the tube.

BRIEF DESCRIPTION OF THE DRAWINGS

Other features and advantages of the present invention will be appreciated from the following description and examination of the appended sets of drawings, in which:

FIG. 19J is a view of a detail of the zone J of FIG. 19G.

DETAILED DESCRIPTION OF THE INVENTION

As will have been understood from the description of the appended Figures, FIGS. 1 to 8K, FIGS. 9 to 12K, and FIGS. 13 to 19J correspond to the first, second and third embodiment of the applicator according to the invention, respectively.

Figure 1:
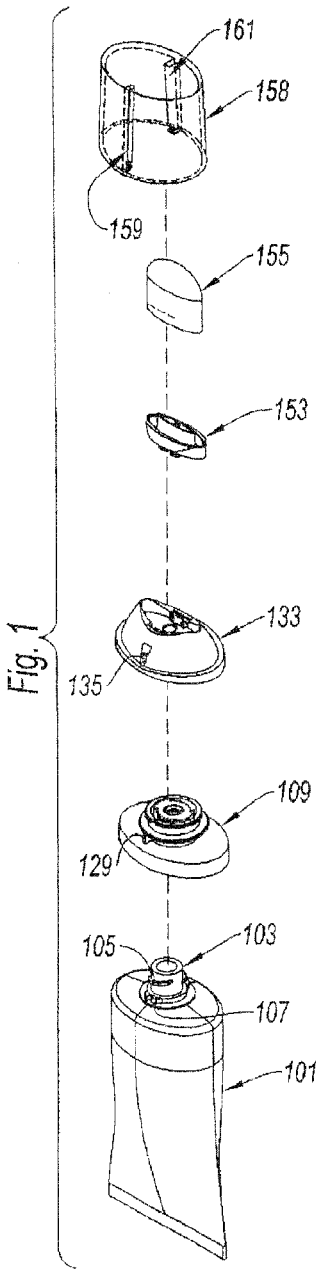
FIG. 1 is an exploded perspective view of a first embodiment of the applicator according to the invention.
Figure 2A:
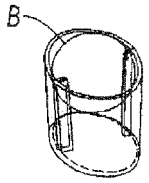
FIG. 2A is an inverted perspective view of the cover of this applicator.
Figure 2B:
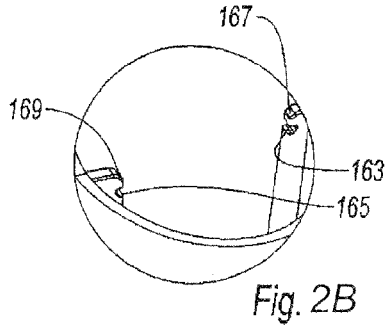
FIG. 2B is a view of a detail of the zone B of the cover of FIG. 2A.

Reference is now made to FIG. 1, in which it can be seen that, according to a first embodiment, the applicator according to the invention comprises a container 101 which is provided with a discharge opening 103 which can, for example, be in the form of a neck, as illustrated.

This neck 103 comprises, at its periphery, a screw thread 105 and, at its base, clip-fit stops 107.

In this first embodiment, the container 101 is a tube whose zone located adjacent to the neck 103 is substantially elliptical in cross-section.

A support ring 109 whose shape corresponds to that of the tube 101 is fixed to the neck 103.

Figure 6B:
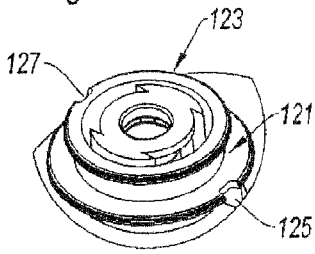
FIG. 6B is a view of a detail of the zone B of FIG. 6A.
Figure 6A:
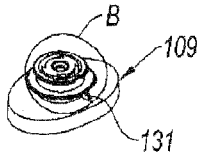
FIG. 6A is a perspective view from a different angle of the support ring of this applicator.
Figure 6C:
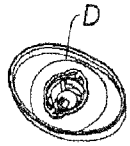
FIG. 6C is an inverted perspective view of the support ring of this applicator.
Figure 6D:
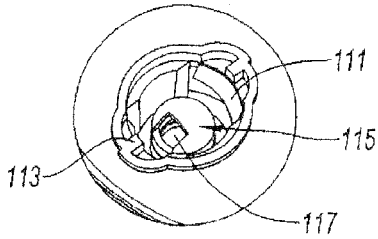
FIG. 6D is a view of a detail of the zone D of FIG. 6C.

As is visible in FIG. 6D, the fixing of the support ring 109 to the neck 103 is carried out by the ring being screwed onto the neck by means of a complementary screw thread 111, then by this ring being clip-fitted to this neck by means of complementary clip-fit stops 113.

In a possible variant, it would be possible to envisage fixing the support ring to the neck simply by clip-fitting in translation: it would simply be necessary, for example, to provide, on the outer face of the neck, at least one rectilinear guiding channel for at least one lug which is fixedly joined to the support ring, and a recess at the end of that channel allowing the corresponding lug to be blocked.

Again with reference to FIG. 6D, it is evident that the support ring 109 comprises a recess-like portion 115 which is suitable for extending inside the neck 103 and which has, at the bottom thereof, a hole 117 which is, for example, rectangular.

Figures 7A, 7B, 7C, 7D, 7E, 7F, 7G, 7H, 7I, 7J:
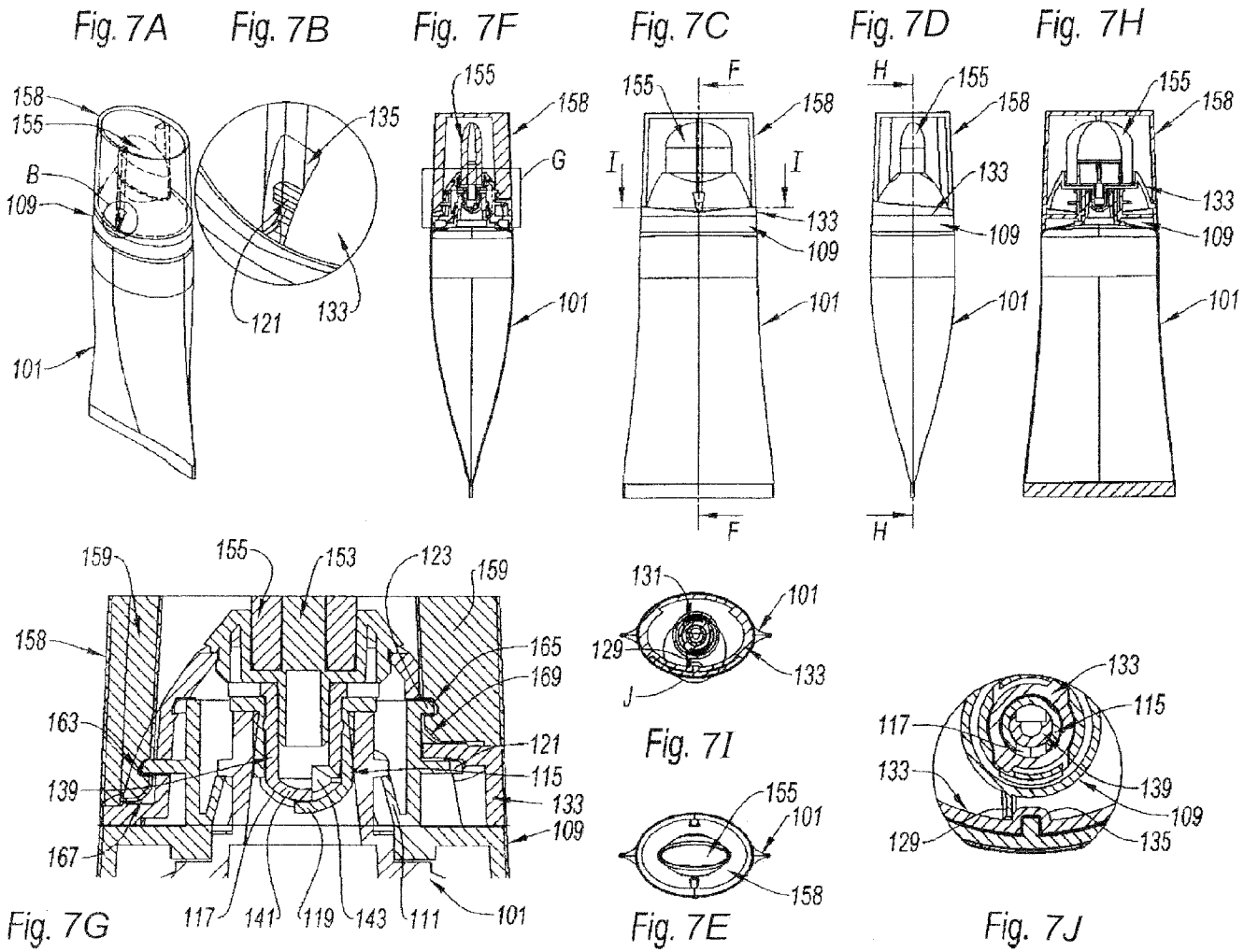
FIG. 7A is a perspective view of the applicator according to the invention when it is in the closed position.
FIG. 7B is a view of a detail of the zone B of FIG. 7A.
FIG. 7C is a front view of this applicator in the closed position.
FIG. 7D is a side view of this applicator in the closed position.
FIG. 7E is a top view of this applicator in the closed position.
FIG. 7F is a sectioned view of this applicator along the line F-F of FIG. 7C.
FIG. 7G is a view of a detail of the zone G of FIG. 7F.
FIG. 7H is a sectioned view of this applicator along the line H-H of FIG. 7D.
FIG. 7I is a sectioned view of this applicator along the line I-I of FIG. 7C.
FIG. 7J is a view of a detail of the zone J of FIG. 7I, FIGS. 8A, 8B, 8C, 8D, 8E, 8F, 8G, 8H, 8I, and 8J are similar to FIGS. 7A to 7J, respectively, for an open position of the applicator.
Figures 8A, 8B, 8C, 8D, 8E, 8F, 8G, 8H, 8I, 8J, 8K:
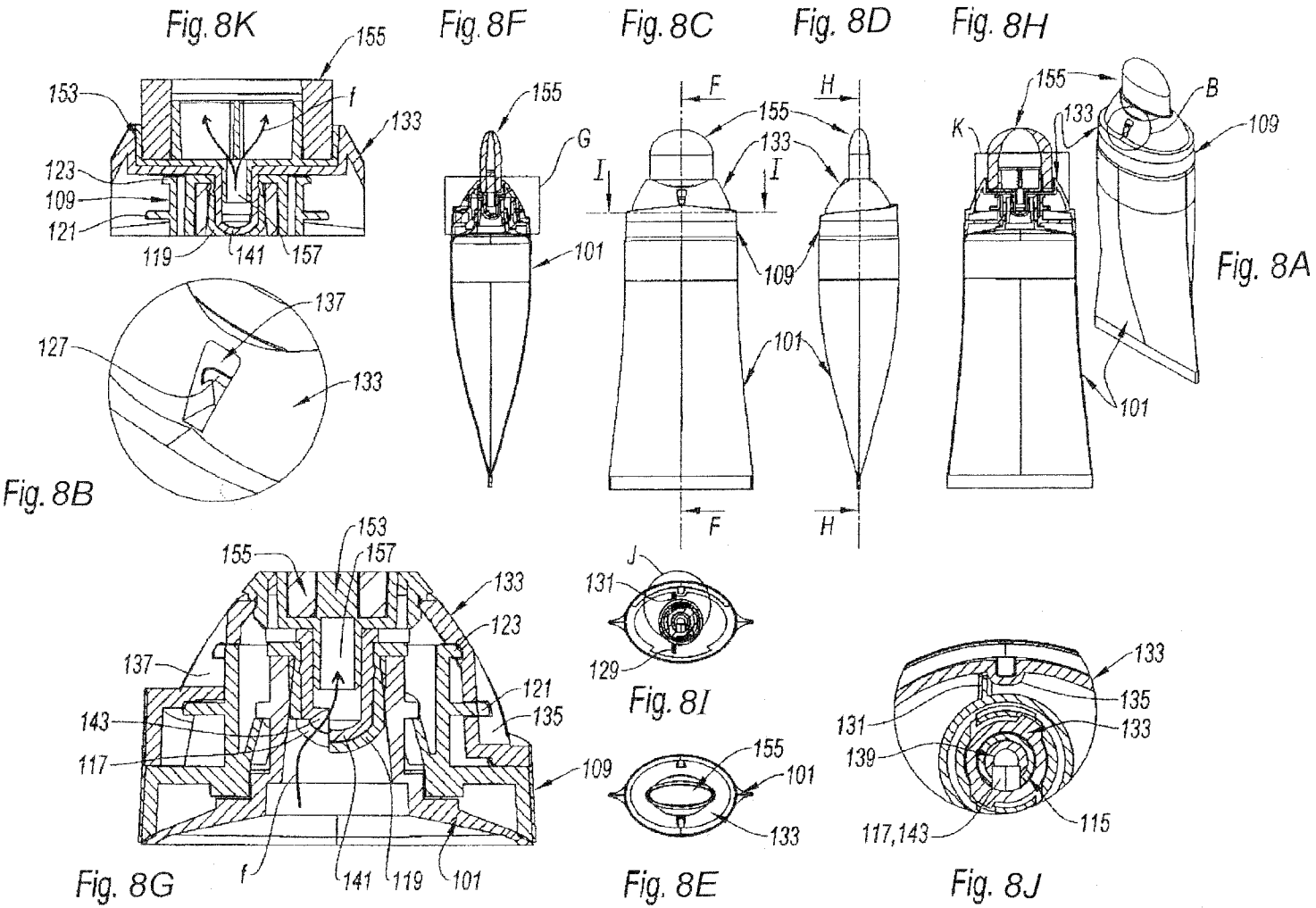
FIG. 8K is a view of a detail of the zone K of FIG. 8H, FIG. 9, similar to FIG. 1, illustrates a second embodiment of the applicator according to the invention.
Figure 9:
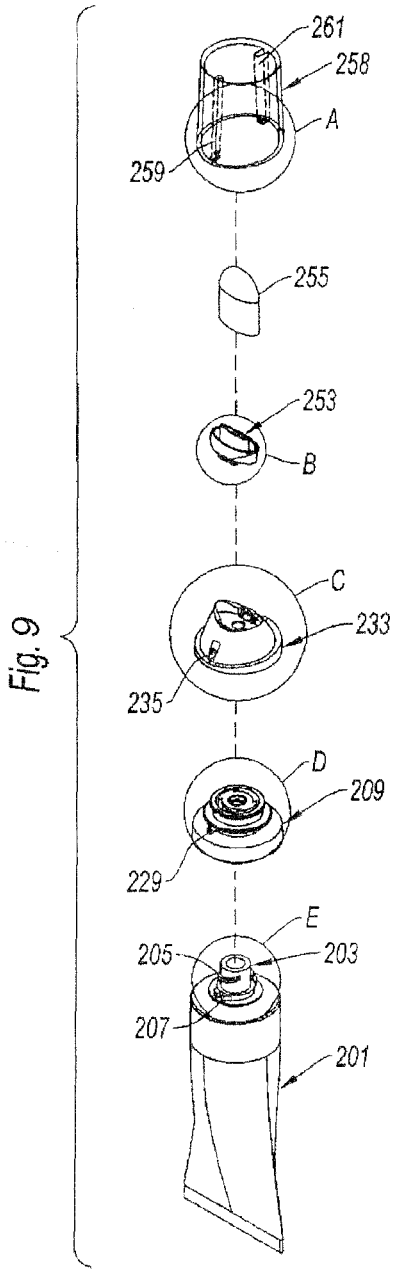
Figure 10A:
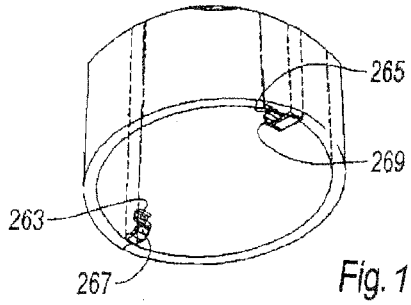
FIGS. 10A, 10B, 10C, 10D and 10E are views of details of the zones A to E of FIG. 9, FIGS. 11A, 11B, 11C, 11D, 11E, 11F, 11G, 11H, 11I, and 11J are views which are similar, for this second embodiment of the applicator according to the invention, to the FIGS. 7A to 7J (applicator in the closed position)
Figure 10B:
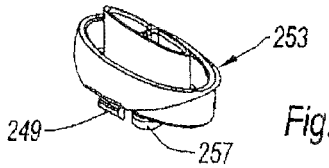
Figure 10C:
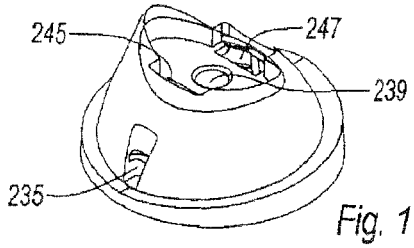
Figure 10D:
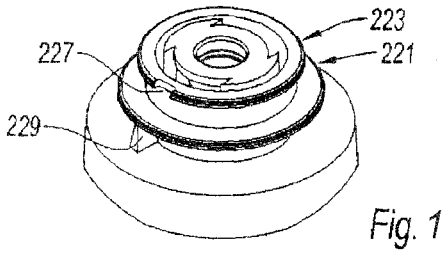
Figure 10E:
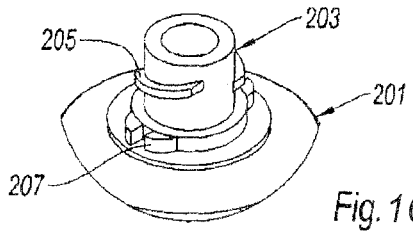
Figures 11A, 11B, 11C, 11D, 11E, 11F, 11G, 11H, 11I, 11J:
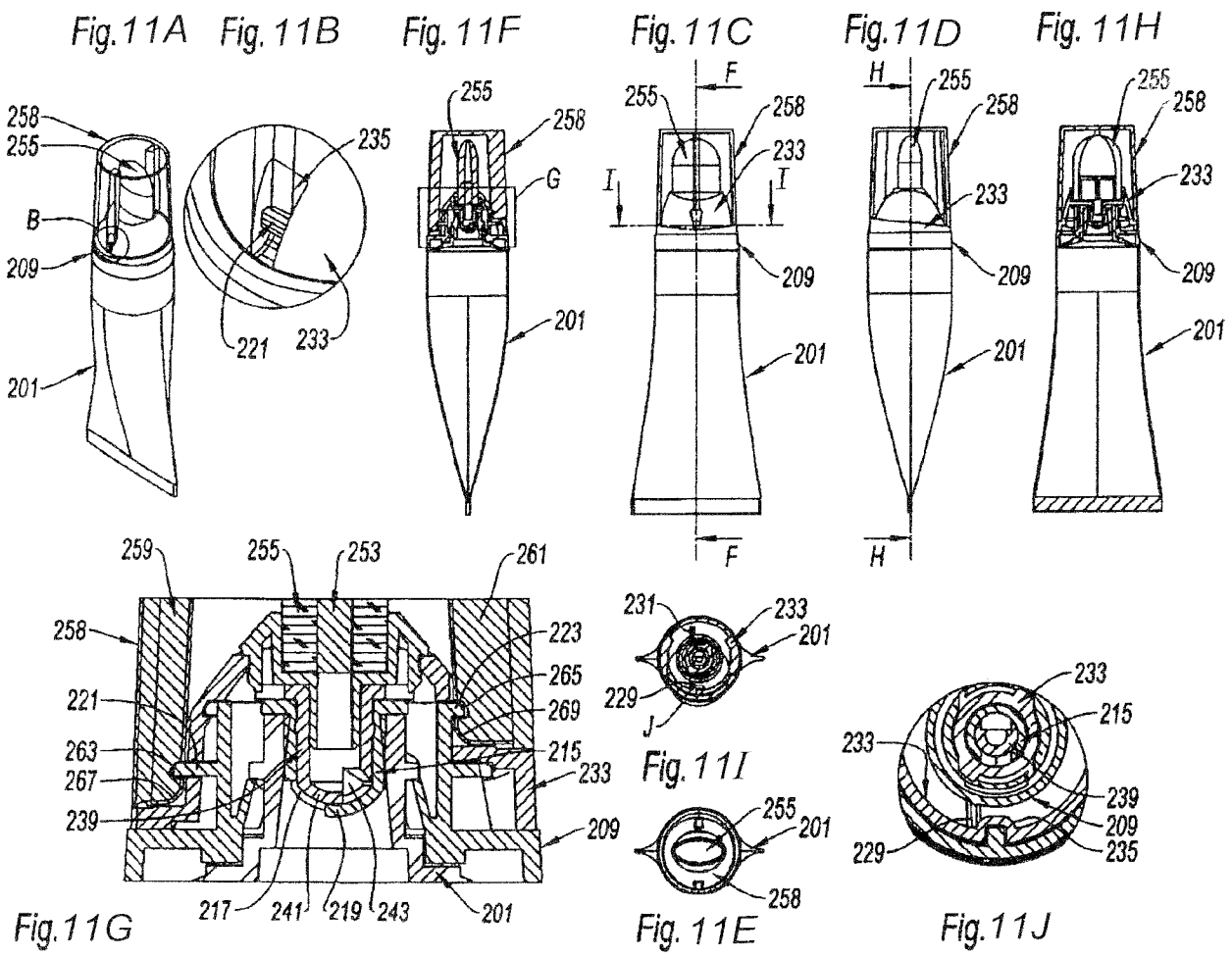
Figures 12A, 12B, 12C, 12D, 12E, 12F, 12G, 12H, 12I, 12J, 12K:
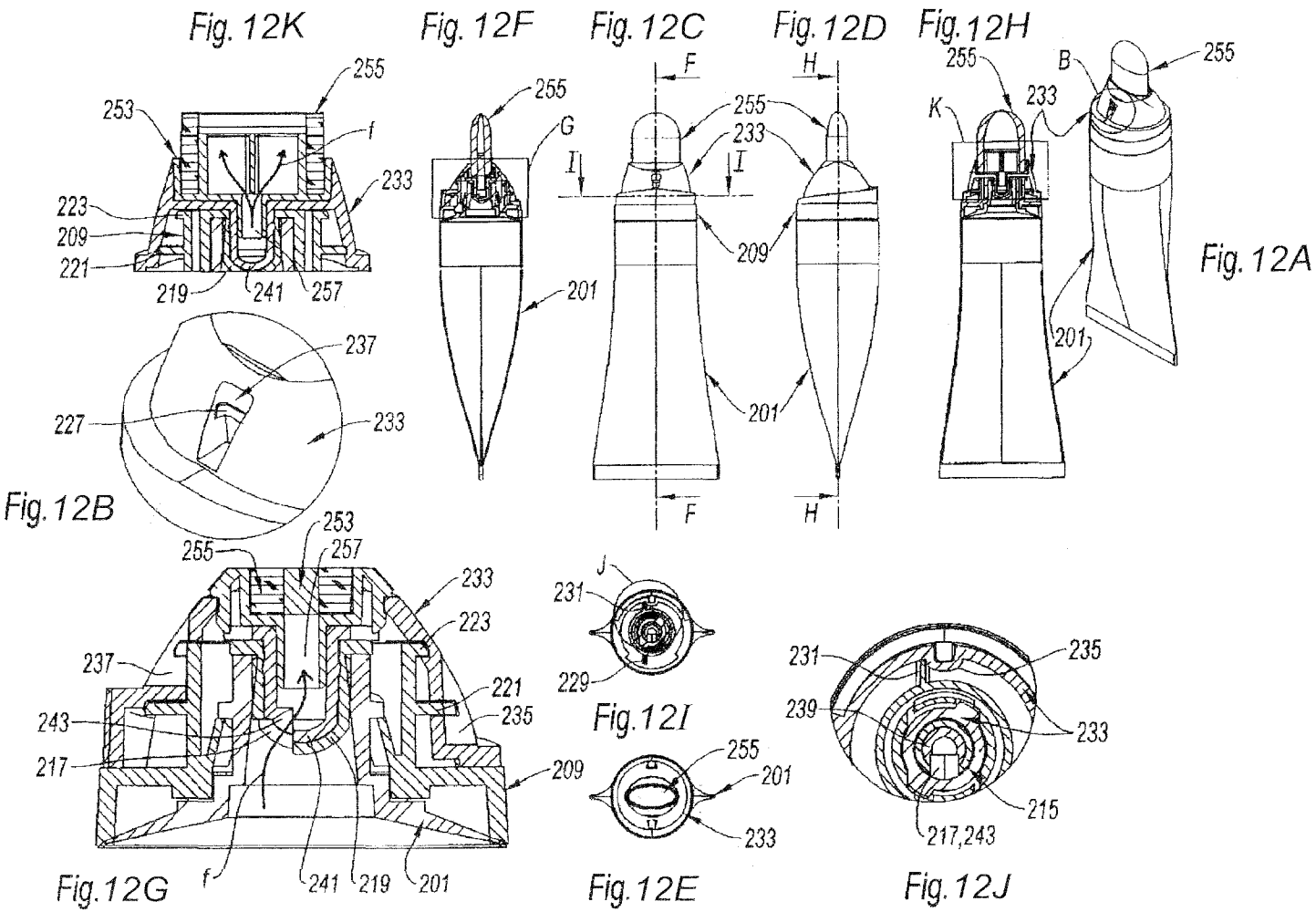
FIGS. 12A, 12B, 12C, 12D, 12E, 12F, 12G, 12H, 12I, 12J, and 12K are views which are similar, for this second embodiment of the applicator according to the invention, to the views 8A to 8K (applicator in the open position)
Figures 13, 14, 15A, 15B, 16A, 16B, 17:
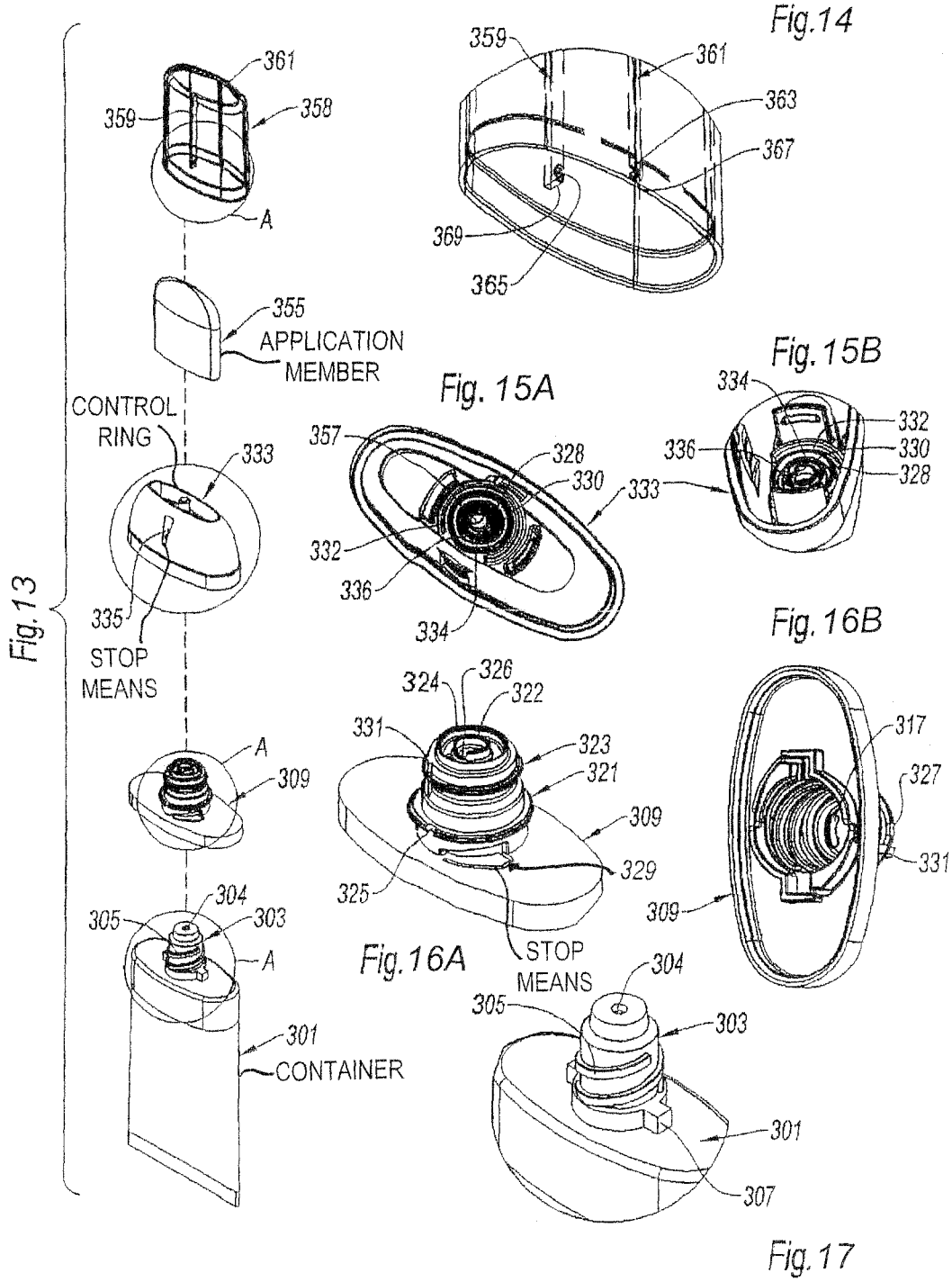
FIG. 13 is an exploded perspective view of a third embodiment of the applicator according to the invention.
FIG. 14 is a view of a detail of the zone A of FIG. 13.
FIG. 15A is an inverted perspective view, drawn to an enlarged scale of the control ring of FIG. 13.
FIG. 15B is an inverted view of a detail of this control ring.
FIG. 16A is a perspective view, drawn to an enlarged scale, of the support ring of FIG. 13.
FIG. 16B is an inverted perspective view, drawn to an enlarged scale, of the support ring of FIG. 13.
FIG. 17 is a view of a detail of the zone A of the container of FIG. 13, FIGS. 18A, 18B, 18C, 18D, 18E, 18F, 18G, 18H, and 18I are views which are similar, for this third embodiment, to the views 7A and 7C to 7J (applicator in the closed position), respectively.

As is visible more particularly in FIGS. 7G and 8G, the bottom 119 of the recess 115 is of curved shape whose concavity is directed towards the inner side of the recess.

As is visible in particular in FIGS. 6B, 7G and 8G, the support ring 109 comprises two discs 121 and 123 which are displaced axially relative to each other, the disc 121 nearer the container 101 having, in this particular instance, a diameter which is greater than that of the disc 123 which is further away.

Each of those discs has, at its periphery, a notch 125, 127, respectively, those two notches being diametrically opposed relative to each other.

As is particularly visible in FIGS. 7I and 8I, the two travel end stops 129 and 131 are provided under the disc 121 having a large diameter.

A control ring 133 is mounted, with simple rotation, on the support ring 109.

That control ring, which has a shape corresponding to the support ring 109, and therefore to the upper portion of the container 101, comprises two housings 135, 137 which are diametrically opposed and in which the discs 121 and 123 project, respectively.

The housing 135 defines, inside the control ring 133, a stop which is suitable for cooperating with the travel end stops 129, 131.

The control ring 133 further comprises a recess 139 which is suitable for being received in a complementary manner inside the recess 115 of the support ring 109.

As is particularly visible in FIGS. 7G and 8G, this recess 139 comprises a curved bottom 141 which is suitable for engaging with the bottom 119 of the recess 115, this bottom 141 being provided with a hole 143 which is capable of moving opposite the hole 117 when the control ring 133 occupies an appropriate angular position relative to the support ring 109.

Figure 3A:
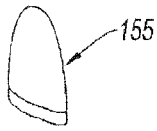
FIG. 3A is a perspective view of a first variant of the application member of this applicator.
Figure 3B:
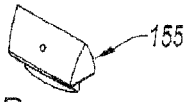
FIG. 3B is a perspective view of a second variant of the application member of this applicator.
Figure 4:
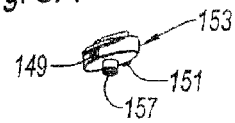
FIG. 4 is a perspective bottom view of the application member support of this applicator.
Figure 5B:
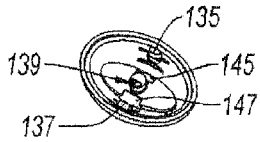
FIG. 5B is an inverted perspective view of this control ring.
Figure 5A:
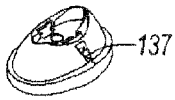
FIG. 5A is a perspective view from a different angle of the control ring of this applicator.

The control ring 133 also comprises two channels 145, 147 which are suitable for receiving, by clip-fitting, the two legs 149, 151 of a support 153 for an application member 155 (see in particular FIGS. 4, 3A, and 3B).

As is particularly apparent in FIGS. 7G and 8G, the support 153 comprises a conduit 157 which is suitable for being positioned inside the recess 139 of the control ring 133 so as to establish a communication of fluid between that recess and the application member 155.

As is visible in FIGS. 1, 3A and 3B, the application member 155 may be of different shapes, such as ogival, conical or prismatic.

That application member, which is intended to move into contact with the skin of a user in order to apply the product contained in the container 101 thereto, may be formed, for example, from latex sponge, synthetic foam or may be composed of a cluster of natural or synthetic bristles, or may be in the form of a flexible spatula which is formed from a material such as Nylon® or silicone and which may comprise an opening for discharging the product.

The applicator also comprises a cover 158 which is suitable for covering the control ring 133.

That cover 158 comprises, on its inner face, two ribs 159, 161 which are diametrically opposed and which are provided with grooves 163, 165 which are suitable for cooperating with the discs 121 and 123 in the housings 135 and 137, respectively.

The rib 159 which is intended to cooperate with the disc 121 having the larger diameter is less thick in radial terms than the rib 161 which is intended to cooperate with the disc 123 of smaller diameter.

The grooves 163 and 165 have the same axial displacement as the discs 121 and 123.

Furthermore, those grooves are shaped so as to prevent the cover 158 from being removed from the control ring 133 as long as the notches 125 and 127 of the discs 121 and 123 are not inside the housings 135 and 137.

It is also possible to provide chamfers 167, 169 at the free ends of the ribs 159, 161 so as to allow the cover 158 to be clipped onto the discs 121 and 123 even when the notches 125 and 127 of those discs are not in the housings 135, 137 of the control ring 133.

As is visible in FIGS. 7C, 7D, 8C, and 8D, it will be appreciated that it is possible to provide for the control ring 133 and the cover 158 to have complementary asymmetrical shapes which allow that cover to be positioned on that control ring only in a single manner.

Those asymmetrical shapes thereby fulfill a function as a one-way guide obliging the user to position the cover on the control ring so that the grooves 163, 165 of the ribs 159, 161 are each positioned on the corresponding disc 121, 123 thereof.

As a variant, that guiding function could be brought about by complementary patterns on the cover and on the control ring, or by references which are located on those two members, or by complementary male and female elements, such as a serration and a lug.

The operating mode and the advantages of the applicator which has been described above are as follows.

Reference is first made to the FIGS. 7A to 7J, in which this applicator is illustrated in the closed position.

In this position, the control ring 133 is orientated so that its housing which forms a stop 135 is in contact against the stop 129 of the support ring 109.

The discs 121, 123 project into the housings 135 and 137 of the control ring 133, respectively.

The cover 158 is positioned on the control ring 133 so that the grooves 163, 165 of those ribs 159, 161 are in engagement with the discs 121 and 123, in the housings 135 and 137, respectively.

The hole 143 of the recess 139 of the control ring 133 is angularly displaced relative to the hole 117 of the recess 115 of the support ring 109 so that no communication of fluid is possible between the container 101 and the conduit 157 of the support 153 for an application member 155.

Therefore, it is not possible to discharge product from the container 101.

It will be appreciated that the contact of the curved bottom 141 with the curved bottom 119 of the type involving a sphere against a sphere makes it possible to obtain complete tightness.

When a user wishes to use the applicator 100, she pivots the control ring 133 through 1800 relative to the support ring 109 so as to reach the configuration illustrated in the FIGS. 8A to 8K.

In the absence of the cover 158, this pivoting can be brought about by acting directly on the control ring 133.

On the other hand, starting from a situation in accordance with the one illustrated in FIGS. 7A to 7J, in which the cover 158 covers the control ring 133, it is possible to pivot the control ring 133 by acting on the cover 158.

When the control ring 133 reaches its open position illustrated in the FIGS. 8A to 8K, the notches 125, 127 of the discs 121, 123 are in the housings 135, 137 of the control ring 133, respectively.

That positioning of the notches 125, 127 allows the grooves 163, 165 formed in the ribs 159, 161 of the cover 158 to be released.

That cover can then be removed so as to uncover the application member 155.

The travel of the control ring 133 between its closed and open positions is limited by the arrival of the stops 129 and 131 in contact against the inner face of the housing 135 (see particularly FIG. 7J for the open position and FIG. 8J for the closed position), respectively.

When the control ring 133 is in its open position, the hole 143 formed in the bottom 141 of the recess 139 of that control ring is opposite the hole 117 which is formed in the bottom 119 of the recess 115 of the support ring 109.

When the control ring 133 has reached its open position, a communication of fluid is thereby brought about between the container 101, the conduit 157 of the support 153 and the application member 155.

That communication of fluid is indicated by the arrows f which are visible in the FIGS. 8G and 8K.

It will be noted that the path of the fluid between the container 101 and the application member 155 is relatively non-sinuous, which prevents losses of loads and thereby optionally allows the applicator to be used for a relatively viscous fluid.

In order to convey the fluid into the application member 155, the user simply has to press on the tube forming the container 101.

Once the use of the applicator has been completed, the user can pivot the control ring 133 through 180° in the opposite direction so as to bring it back into its closed position, then snap-fit the cover 158 onto that control ring.

That snap-fitting is made possible by the chamfers 167, 169 which are formed on the free ends of the ribs 159, 161.

The user can also begin by positioning the cover 158 on the control ring 133 in an open position, then pivot that control ring and that cover towards the closed position, by means of which the grooves 163, 165 of the ribs 159, 161 move into engagement by sliding on the discs 121, 123, respectively.

As may be understood from the above, the movement from the closed configuration to the open configuration, and vice versa, is brought about by a simple rotational movement, that is to say, a movement not involving any translation, of the control ring 133 relative to the support ring 109.

The stops 129, 131 delimit the travel of the control ring 133 by means of their cooperation with the inner face of the housing 135.

In particular, the stop 129 allows precise positioning of the control ring 133 to be obtained relative to the support ring 109 and the container 101 in a closed position.

That precise positioning allows, particularly when the container 101 has a non-rotationally symmetrical shape, such as an elliptical shape as indicated above, correct alignment of the control ring 133 and its cover 158 to be obtained relative to the body of the applicator.

It will further be noted that the simple rotational movement of the control ring 133 allows the problem of production tolerances to be limited to that single movement, which considerably simplifies matters with respect to the helical movement of the prior art, in which not only rotational movement tolerances but also translational movement tolerances have to be taken into consideration.

It will further be noted that the simple rotational movement of the control ring 133, which does not require any screw thread to be used, allows problems involving wear of screw threads which are encountered in the prior art to be overcome, and thereby satisfactory tightness to be maintained without it being necessary to carry out more extensive securing following each use.

It will be noted from the remainder that this tightness is greatly improved by the specific formation of the bottoms 119 and 141 of the recesses 115 and 139 which bring about contact of the sphere-against-sphere type which is particularly reliable over time.

Naturally, the present invention is in no way limited to an applicator which has the shape of the embodiment described above.

Thus, in particular it is possible to refer to FIGS. 9 to 12K, illustrating a second embodiment of the applicator according to the invention, in which the container 201, the support ring 209, the control ring 233 and the cover 258 are of circular shape.

Besides this difference in shape, that second embodiment is completely similar to the first embodiment and for this reason will not be described in detail.

In the case of this second embodiment, it is true that the question of alignment of the shapes of the control ring 233 and the assembly formed by the container 201 and the support ring 209 is no longer presented in such acute terms as in the case of the first embodiment.

However, when the control ring 233 and the cover 258, on the one hand, and the container 201 and the support ring 209, on the other hand, carry complementary logos or patterns, it may be found to be just as important as in the case of the first embodiment that, in a closed position, those two assemblies occupy a correctly predetermined alignment position.

It will be noted that, in the two embodiments which have been described above, provision has been made for the curved bottoms bringing about sphere-against-sphere contact to be positioned inside the neck of the container.

In a variant (not illustrated), and particularly (but not uniquely) if the neck is too small, it is possible to provide for the support ring and the control ring to be formed in such a manner that those curved bottoms are located outside the neck.

FIGS. 13 to 19J illustrate another embodiment in which, just as in the first embodiment, the container 301, the support ring 309, the control ring 333 and the cover 358 have an elliptical shape.

Hereinafter, only the differences of this embodiment in relation to the preceding embodiments will be described, it being understood that the numbering of the reference numerals in the figures allows correspondence between similar members and configurations to be immediately established once again.

In this embodiment, the neck 303 of the container 301 comprises an opening 304 which is too small to allow the introduction of recesses of the support ring 309 and the control ring 333.

Figures 18A, 18B, 18C, 18D, 18E, 18F, 18G, 18H, 18I:
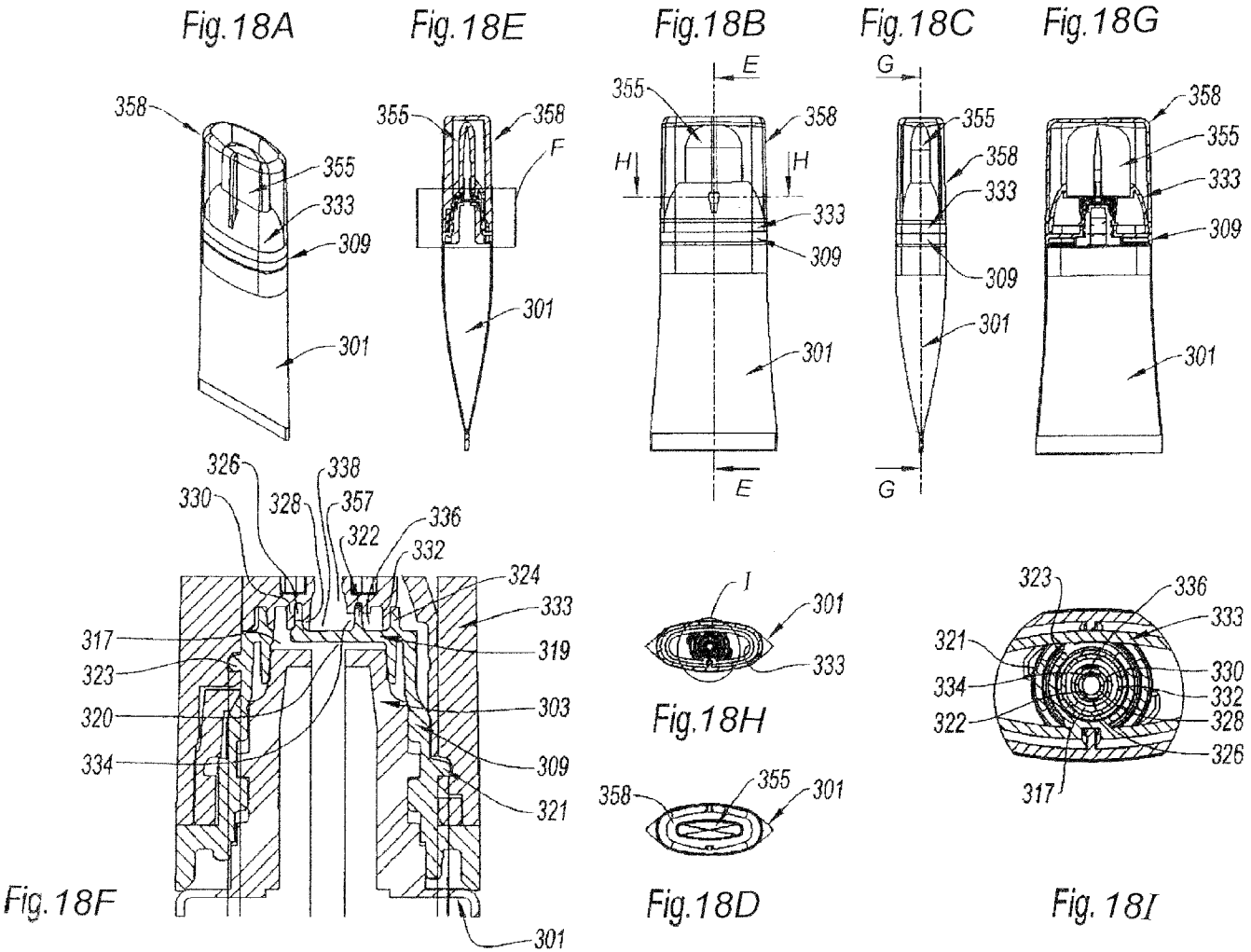
Figures 19A, 19B, 19C, 19D, 19E, 19F, 19G, 19H, 19I, 19J:
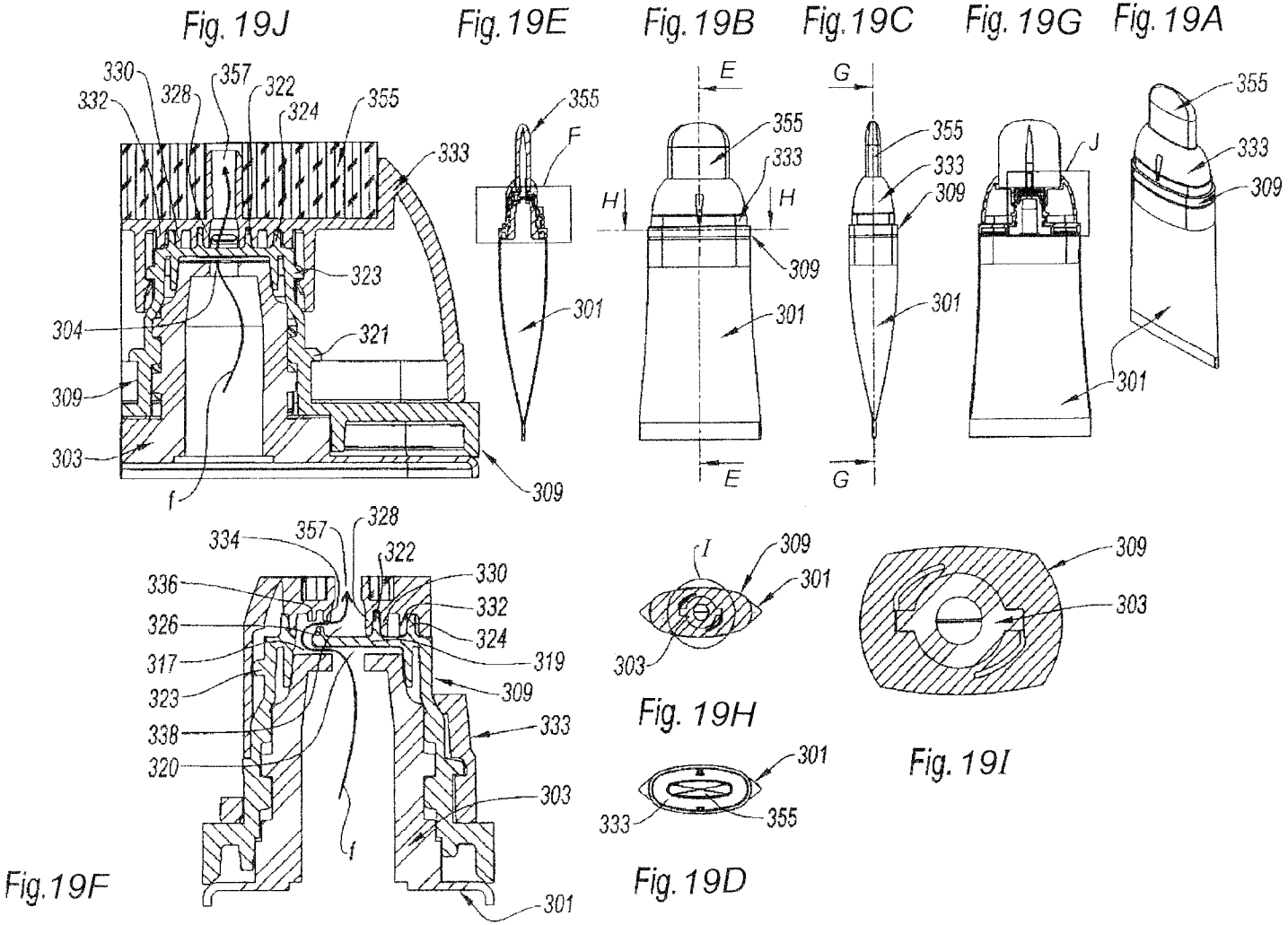
FIGS. 19A, 19B, 19C, 19D, 19E, 19F, 19G, 19H, 19I, and 19J are views which are similar, for this third embodiment, to the FIGS. 8A and 8C to 8K (applicator in the open position), respectively.

For this reason, and as is particularly visible in FIGS. 18F and 19F, the support ring 309 comprises, above the disc 323, a plate 319 which is provided with an eccentric hole 317 and two concentric skirts 322, 324.

Adjacent to the hole 317, the inner skirt 322 has a serration 326.

The plate 319 defines a chamber 320 above the neck 303 (see FIGS. 18F and 19F).

The control ring 333 is itself provided with three concentric skirts 328, 330, 332.

The inner skirt 322 of the plate 319 is interposed between the two concentric inner skirts 328, 330 of the plate 341.

The two concentric inner skirts 328, 330 have serrations 334, 336.

The chamber 338 delimited by the skirt 322 permanently communicates with a conduit 357 which opens in the application member 355.

It will be appreciated that, unlike the preceding embodiments, in this case there is no intermediate component between the control ring and the application member 355.

The operating mode and the advantages of the applicator according to this embodiment result directly from the preceding description.

When the applicator is in the closed position (see FIGS. 18A to 18I), the serration 326 of the skirt 322, on the one hand, and the serrations 334, 336 of the skirts 328, 330, on the other hand, are not located opposite each other (see FIG. 18F).

Under those conditions, the skirts 328 and 330 form a barrier with respect to the serration 326 and communication of fluid is not possible between the chamber 320 and the conduit 357.

When this applicator is moved into an open position by the control ring 333 being rotated through 180° relative to the container 301 (see FIGS. 19A to 19J), the serrations 334 and 336 of the skirts 328 and 330 of the control ring 333 are positioned facing the serration 326 of the skirt 322 of the support ring 309, as is visible in FIG. 19F, thereby allowing communication of fluid between the chamber 320 and the conduit 357.

The fluid located inside the container 301 can then flow in the direction towards the application member 355 after passing through the neck 303, the chamber 320, the three serrations 336, 326, 334 and the conduit 357.

This embodiment is particularly advantageous for containers whose neck is too small to receive recesses, as in the two preceding embodiments, or whose neck, although it is of sufficient size, has an excessively small opening.

This embodiment particularly allows the opening/closing mechanism according to the invention to be adapted to commercial tubes which, at the outset, were not provided for receiving such a mechanism.

However, this embodiment could also be advantageous for containers whose neck is large and it would further be possible in this case to envisage placing the mechanism having skirts at the bottom of recesses inside the neck in a manner similar to the first two embodiments described above.

Naturally, the present invention is in no way limited to the embodiments which are described and illustrated and which are provided by way of non-limiting example.

In this manner, firstly, though it is true that the travel through 180° for the control ring is most particularly advantageous for tubes having two axes of symmetry, such as tubes having an elliptical cross-section, it would be completely possible to envisage other travel angles, either for this type of tube or for other types of tube (circular, square, triangular tubes, etc.).

For these other travels, the two discs which allow locking/unlocking of the cover could optionally have the same diameter and be provided with notches which are positioned in an appropriate manner, those notches optionally being able to have angular extents greater than those of the corresponding ribs of the cover.

It would also be possible to imagine a single disc which is provided with a plurality of notches, or more than two discs, etc.

In other words, all possible combinations of numbers and diameters of discs, numbers, positions and shapes of notches can be envisaged, without for all that departing from the scope of the present invention. Furthermore, it would also be possible to envisage that the support ring 109, 209 be formed in a single piece with the container 101.

In summary, and in light of the entire preceding description, it will be understood that, whatever the size of the neck, there is a choice between a mechanism of the sphere-against-sphere type and a mechanism having skirts.

When the neck is large, it is possible to position those mechanisms inside the neck (by means of "recesses" as set out above) or outside the neck.

When the neck is small, it is necessary to envisage positioning those mechanisms outside the neck.

It will further have been understood that using an independent support ring between the container and the control ring is optional, and that it is completely possible to envisage that this support ring is in fact part of the container.

Naturally, an independent support ring has the advantage of being able to be adapted to tubes which already exist.

Furthermore, it will be appreciated that the provision of a removable application member support is also optional and has the advantage of making the application member removable, either in view of cleaning or in view of replacement thereof.

The invention claimed is:

1. An applicator for a fluid product, such as a cosmetic product, of the type comprising:

a container which is provided with a discharge opening, a control ring which is mounted so as to be movable on the container between a closed position, in which it blocks the opening, and an open position, in which it releases the opening, and an application member which is mounted on the control ring so as to communicate with the opening when the ring is in its open position, in which applicator the control ring is mounted with simple rotational movement, not involving translational movement relative to a support ring, free of any translation, stop means being provided in order to stop the travel of the ring towards its closed position.

2. An applicator according to claim 1, further comprising a removable cover which is mounted on the control ring, and means for locking the cover on the control ring when the ring is in the closed position, and for unlocking the cover when the ring is in its open position.

3. An applicator according to claim 2, wherein the locking/unlocking means comprise:

at least two discs which are fixedly joined to the container and which are axially spaced apart from each other, and each of which is provided with a notch, the notches of the two discs being diametrically opposed, at least two housings which are formed in the control ring, those housings each receiving one of the discs and being arranged so that, when the control ring is in the open position, the notches are in the housings, respectively, and at least two grooves which are formed inside the cover and which are arranged so as to be positioned in the housings and to cooperate with the discs, respectively, those grooves being formed in order to prevent the cover from being removed as long as the notches are not in the housings and to allow removal when those notches are in those housings, respectively.

4. An applicator according to claim 3, wherein the control ring and the cover are formed so as to allow only a single relative positioning of those two components.

5. An applicator according to claim 1, wherein the blocking and release of the opening is brought about by cooperation between two complementary curved members which are provided with holes and which are fixedly joined to the control ring and the container, respectively, the holes of those members being mutually displaced when the control ring is in its closed position and those holes being at least partially opposite each other when the control ring is in its open position.

6. An applicator according to claim 1, wherein the control ring is mounted with simple rotation on the container by means of a support ring which is itself mounted so as to be fixed in position on this container, the support ring comprising, depending on whether the applicator is constructed in accordance with claims 3 and 5, respectively, the two discs which are provided with notches and one of the curved members.

7. An applicator according to claim 6, wherein the control ring and the support ring comprise complementary recesses, respectively, at the bottom of which the curved members are positioned, those recesses extending inside the opening.

8. An applicator according to claim 1, wherein the blocking and release of the opening is brought about by cooperation between several skirts which are provided with complementary serrations, which are fixedly joined to the control member and the container, respectively, the serrations of those skirts being mutually displaced when the control ring is in its closed position, and those serrations being at least partially opposite each other when the control ring is in its open position.

9. An applicator according to claim 8, wherein said skirts are positioned outside the container.

10. An applicator according to claim 8, wherein the skirts are positioned inside the container.

11. An applicator according to claim 1, wherein the application member is mounted on a support which is itself mounted so as to be removable on the control ring.

12. An applicator according to claim 1, wherein the container is a tube which may be of any shape, and which is particularly elliptical, circular, square or triangular, the shapes of the control ring, the cover and, where applicable, the support ring and the support of an application member being adapted in order to correspond to the shape of the tube.

* * * * *